United States Patent [19]

Cochran

[11] 4,402,287

[45] Sep. 6, 1983

[54] OIL FILTER ADAPTER

[75] Inventor: Clarence L. Cochran, Stockton, Calif.

[73] Assignee: Frantz Filters, Inc., Stockton, Calif.

[21] Appl. No.: 349,299

[22] Filed: Feb. 16, 1982

[51] Int. Cl.[3] ..... F01M 11/03

[52] U.S. Cl. ..... 123/196 A; 210/232; 285/177

[58] Field of Search ..... 123/196 R, 196 A; 184/6.24; 210/232; 285/177

[56] References Cited

U.S. PATENT DOCUMENTS

| | | | |
|---|---|---|---|
| 3,308,956 | 3/1967 | Yee et al. | 210/316 X |
| 3,540,594 | 11/1970 | Sanderson | 210/232 |
| 4,174,699 | 11/1979 | Gill | 123/196 A X |
| 4,335,688 | 6/1982 | Diederich, Jr. | 123/196 A |

*Primary Examiner*—Tony M. Argenbright

*Attorney, Agent, or Firm*—Townsend & Townsend

[57] ABSTRACT

An adapter for connecting a bypass oil filter to an internal combustion engine having a full-flow lubricating system is mounted in place of the conventional full-flow oil filter. The adapter includes a body portion which defines three interconnected passages. A first passage provides for the flow of dirty oil from the adapter to the bypass filter, while a second passage provides for the return of the filtered oil to the engine. A third passage extends between the first and second passages and allows most of the dirty oil to flow directly back to the engine. By providing a return tube with an outlet downstream of the junction of the second and third tubes, the bypass filter experiences a maximum pressure drop increasing the amount of oil flowing therethrough.

5 Claims, 5 Drawing Figures

OIL FILTER ADAPTER

BACKGROUND OF THE INVENTION

1. Field of the Invention

The present invention relates generally to a bypass oil filtering system for an internal combustion engine, and more particularly to an adapter for connecting the bypass filter to the engine lubrication system.

In general, internal combustion engine lubrication systems operate on either a full-flow or bypass principle. In full-flow operation, the entire circulating oil stream is passed through the engine oil filter before it returns to the engine. In a bypass system, only a portion of the circulating oil stream is passed through the engine oil filter prior to being returned to the engine. Typically, an oil filter used in the bypass system will be more efficient and achieve a higher degree of contaminant removal than a filter in the full-flow system. Conversely, the filter in the full-flow system must use a coarse filtering media capable of passing the large volume of oil required to lubricate the engine. Such a coarse media allows small contaminant particles to circulate freely through the engine, causing sludge deposits and contributing to engine wear. Moreover, as dirt accumulates in a full-flow filter, the flow of oil is restricted. To prevent cessation of oil flow, the full-flow filter must be provided with a bypass valve that opens when the pressure drop across the full-flow filter becomes excessive. The bypass valve allows oil to continue circulating, but such oil is not filtered at all.

Because of the deficiencies in the full-flow oil lubrication system, many people desire to provide their automobiles, or other internal combustion engines, with a bypass oil filtering system. Converting the internal passages which comprise the lubrication system is virtually impossible, since the passages are formed in the engine block itself. Thus, it would be desirable to provide a means for easily converting an internal engine having a full-flow lubrication system to operate with a bypass oil filter.

2. Description of the Prior Art

A bypass oil filter is described in U.S. Pat. No. 3,308,956 to Yee et al. An oil filter adapter for connecting a bypass filter to an internal combustion engine having a full-flow lubrication system, while leaving the full-flow filter in place, is disclosed in U.S. Pat. No. 3,540,594 to Sanderson.

SUMMARY OF THE INVENTION

The present invention provides an adapter which may be mounted on a conventional filter mounting block on an internal combustion engine having a full-flow lubrication system. The adapter provides a bypass oil flow which comprises from about 5 to 25% of the total circulating oil flow in the engine. The remaining portion of the circulating oil flow is returned directly to the engine without passing through a filter of any kind. In this way, the advantages of the bypass oil filtering system may be enjoyed in an engine having a full-flow lubricating system.

The adapter comprises a body having three passages formed therein. The first passage allows oil to flow from the engine to the bypass filter. A second passage allows oil which has been filtered to return to the engine. A third passage, formed between the first passage and the second passage, allows oil from the engine to return directly to the engine without passing through the bypass filter. By properly sizing each of the passages, the proper ratio of bypass flow to return flow may be achieved.

In the preferred embodiment, the second passage is located axially in the body and is threaded at one end for engaging a return nipple on the filter mounting block. When so mounted, the base of the adapter which lies adjacent the mounting block and the mounting block itself together define a supply plenum which receives the full flow of dirty oil from the engine. Both the first and third passages are in fluid communication with the supply plenum. The first passage allows a portion of the oil to flow directly to the bypass filter, while the third passage directs the remaining oil from the supply plenum to the return passage where it mixes with the oil returning from the bypass filter before being directed back to the engine.

A return tube may be provided in the second passage for directing the flow of filtered oil back into the adapter. By terminating the return tube at a point proximate the engine return nipple, and joining the second (bypass) passage at a point remote from the return nipple, backpressure experienced by the oil returning to the adapter is minimized.

DESCRIPTION OF THE PREFERRED EMBODIMENT

Figure 1:
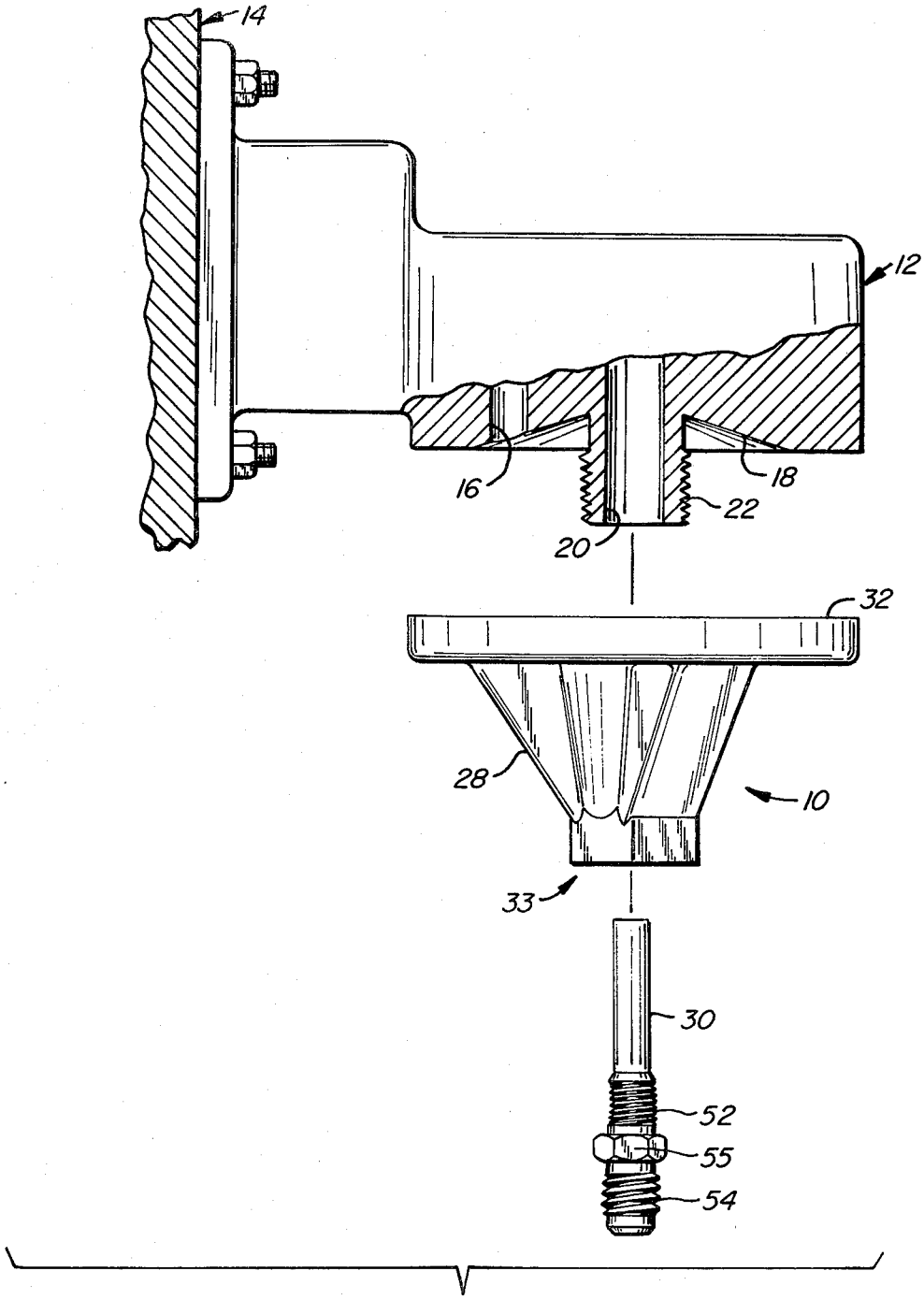
FIG. 1 is an exploded view showing the filter adapter of the present invention and the filter mounting block.
Figure 2:
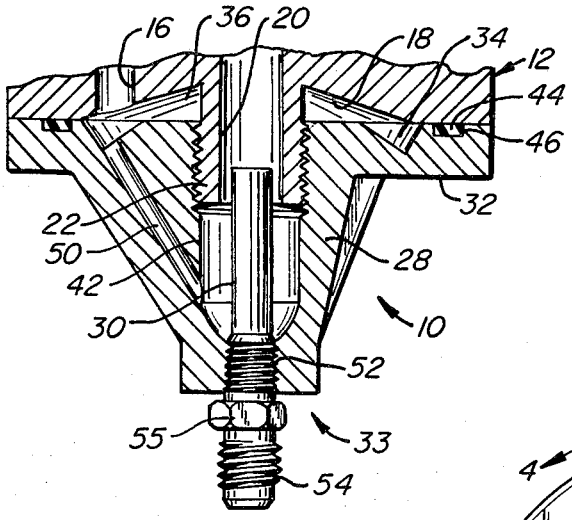
FIG. 2 is a sectional view illustrating the adapter mounted on the filter mounting block.
Figure 3:
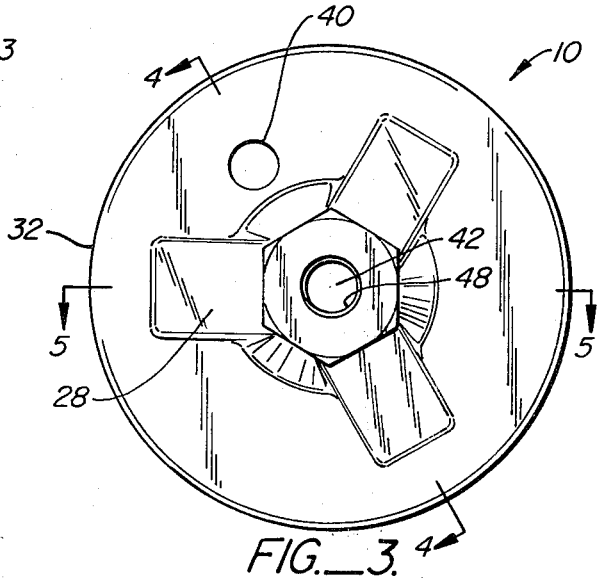
FIG. 3 is a bottom view of the adapter.
Figure 5:
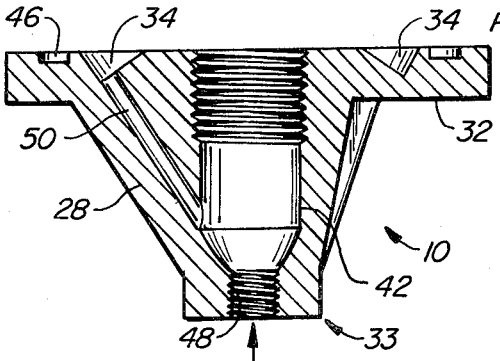
FIG. 5 is a sectional view taken along line 5—5 of FIG. 3.
Figure 4:
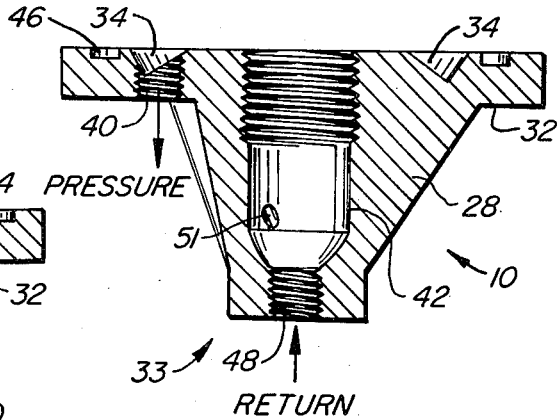
FIG. 4 is a sectional view taken along line 4—4 of FIG. 3.

Referring to FIGS. 1 and 2, an adapter 10 may be mounted on an oil filter mount 12 of an internal combustion engine 14 (partially illustrated in FIG. 1) having a full-flow lubrication system. With such a lubrication system, the entire recirculating oil flow of the engine is directed to a conventional oil filter (not shown), typically by a passage such as outlet 16, terminating in a conical depression 18 formed in one end of the oil filter mount 12. The full flow of oil is returned to the engine through inlet 20, defined by a threaded nipple 22 located at the apex of the conical depression 18. Although the oil filter mount 12 just described is typical of those found on internal combustion engines, such as automobile engines, the exact configuration may vary. The adapter 10 of the present invention, however, is intended to mount on any oil filter mount capable of accepting a conventional full-flow oil filter.

Referring now to FIGS. 1–5, the adapter 10 includes a body 28 and a return tube 30. The body 28 is typically a casting, such as an aluminum casting, machined in the manner described hereinafter. The shape of the casting 28 is generally conical, having a base flange 32 with a diameter corresponding to that of the oil filter mount 12 and terminating at an apex 33 opposite the base 32.

An annular depression 34 is formed in the radial face of the base flange 32. When the adapter 10 is mounted on the oil filter mount 12, as illustrated in FIG. 2, the conical depression 18 in the mount 12 and the annular depression 34 in the base 32 together define a supply plenum 36 (FIG. 2), which receives dirty oil from the outlet 16.

A first passage or port 40 (FIGS. 3 and 4) extends through the base flange 32 and provides fluid communication with the supply plenum 36. The passage 40 is typically threaded, and a flexible conduit (not shown) will be provided to carry oil from passage 40 to the bypass filter remotely mounted within the engine compartment.

A second passage 42 runs axially from the apex 33 to the base 32 of the adapter body 28. The passage 42 is threaded near the base 32 to receive the threaded nipple 22 of the filter mount 12. In this way, the adapter 10 can be mounted on the filter mount 12 simply by screwing it on. A gasket or O-ring 44 (FIG. 2) is retained within an annular channel 46 in the base flange 32 and assures that the adapter 10 is tightly sealed against the filter mount 12.

The second passage 42 terminates in a second threaded port 48 in the apex 33. Port 48 defines the oil return connection for the return line (not shown) from the bypass filter.

A third passage 50 in the adapter body 28 extends between supply plenum 36 and the inlet end of the second passage 42, defining a port 51 (FIG. 4) in the wall of the second passage. The third passage 50 allows dirty oil from outlet 16 to flow directly back to inlet 20 without passing through the bypass filter.

The return tube 30 includes a threaded middle portion 52 which is received in the threaded port 48 of the second passage 42. The tube 30 terminates at one end in a threaded nipple 54 and includes a hexoginal nut 55 which allows the user to insert and remove the tube from the adapter body 28.

The return tube 30 extends into the second passage 42 and terminates within the oil inlet 20 of the filter mount 12. The termination point is well beyond the port 51 of the third passage 50 which provides for the direct return of dirty oil to the inlet 20. The major portion of the pressure drop in the adapter 51 occurs as the direction of oil flow is reversed as the oil flows from the third passage to the second passage. By introducing the return filtered oil at a point downstream of this flow restriction, the pressure drop which causes oil to flow through the bypass filter is maximized. By returning the flow of oil directly to port 48 (i.e., without the return tube 30), insufficient pressure drop is generated to flow the desired amount of oil through the bypass filter.

To utilize the adapter 10, the user removes the conventional full-flow filter on the internal combustion engine and mounts the adapter onto the exposed nipple 22, using a wrench to tighten the hexagonal apex 33. The bypass filter may be mounted anywhere within the engine compartment and hydraulic lines (not shown) are used to connect the bypass filter to the adapter 10. Specifically, an outlet hydraulic line is connected to port 40 and to the inlet of the bypass filter, while an inlet hydraulic line connects the outlet of the bypass filter to the nipple 54 of the return tube 38. After these connections are made, a predetermined portion of the oil flow will be directed through the bypass filter and returned to the engine when the engine is running.

The amount of oil directed to the bypass filter depends on a number of factors, including the fluid resistance of the bypass filter and the pressure drop between the port 40 and the return 54. This pressure drop, in turn, depends on the internal resistance of the return flow path within the adapter 10.

As stated hereinabove, it is desirable that the pressure drop between the nipple 54 and the port 40 be maximized, while minimzing the overall pressure drop experienced by the engine. By providing the return tube 52, the pressure drop which drives the oil through the bypass filter closely approaches the overall pressure drop across the adapter 10.

Although the best mode contemplated for carrying out the present invention has been herein shown and described, it will be appreciated that variations and modifications may be made without departing from what is regarded to be the subject matter of the present invention.

What is claimed is:

1. In combination with an engine lubricating system including a filter mounting block having a dirty oil outlet and a clean oil inlet for passing oil from and to said engine, an adapter for connecting a bypass filter having a dirty oil inlet and a filtered oil outlet, said adapter comprising:

an adapter body including means for mounting said body on the filter mounting block, said body having a first passage therethrough which defines direct a flow path between the dirty oil outlet and the bypass filter, a second passage therethrough which defines a direct flow path between the bypass filter and the clean oil inlet and a third passage between the first passage and the second passage whereby a portion of the oil from the engine is returned directly to the engine without passing through the bypass filter, said third passage being substantially unobstructed.

2. An adapter as in claim 1, further comprising means for receiving oil from the filtered oil outlet of the bypass filter and for discharging said oil into the second passage at a point downstream of the junction of the second and third passages.

3. An adapter as in claim 2, wherin said means for receiving and discharging comprises a tube axially aligned within the second passage to isolate the return flow of filtered oil from the return flow of dirty oil until reaching a location substantially at the clean oil inlet end, wherein said tue has an outside diameter which is less than the inside diameter of the second passage so that oil from the third passage is able to flow through the annular space therebetween.

4. An adapter as in claim 1, wherein the means for mounting comprises a threaded port in the second passage, said threaded port adapted to engage a threaded nipple which defines the clean oil inlet on the filter mounting block.

5. In combination with an engine lubricating system including a filter mounting block having a dirty oil outlet and a clean oil inlet for passing oil from and to said engine, an adapter for connecting a bypass filter having a dirty oil inlet and a filtered oil outlet, said adapter comprising:

an adapter body including means for mounting said body on the filter mounting block, said body having a first passage therethrough which defines a direct flow path between the dirty oil outlet and the bypass filter, a second passage therethrough which defines a direct flow path between the bypass filter and the clean oil inlet, a third passage between the first passage and the second passage, and a tube axially aligned within the second passage and arranged to receive the oil from the clean oil inlet, said tube having an outside surface which is spaced apart from the inside of the second passage to define an annular flow path for the oil from the third passage, whereby a portion of the oil from the engine is returned directly to the engine without passing through the bypass filter.

* * * * *